US006642902B2

(12) United States Patent
Gustafson

(10) Patent No.: US 6,642,902 B2
(45) Date of Patent: Nov. 4, 2003

(54) LOW LOSS LOADING, COMPACT ANTENNA AND ANTENNA LOADING METHOD

(75) Inventor: Eric S. Gustafson, Tucson, AZ (US)

(73) Assignee: Kenneth A. Hirschberg, Tucson, AZ (US); part interest ( * ) Notice: Subject to any disclaimer, the term of this patent is extended or adjusted under 35 U.S.C. 154(b) by 0 days.

(21) Appl. No.: 10/117,952

(22) Filed: Apr. 8, 2002

(65) Prior Publication Data

US 2003/0189526 A1 Oct. 9, 2003

(51) Int. Cl.[7] ..... H01Q 9/40
(52) U.S. Cl. ..... 343/791; 343/802; 343/830
(58) Field of Search ..... 343/790, 791, 343/792, 793, 802, 825, 829, 830

(56) References Cited

U.S. PATENT DOCUMENTS

| | | | | |
|---|---|---|---|---|
| 2,594,055 A | * | 4/1952 | Miller | 343/792 |
| 2,648,768 A | * | 8/1953 | Woodward, Jr. | 343/802 |
| 3,427,624 A | | 2/1969 | Wanselow et al. | 343/750 |
| 3,573,839 A | | 4/1971 | Parker | 343/792.5 |
| 3,838,429 A | | 9/1974 | Reggia | 343/750 |
| 3,967,276 A | | 6/1976 | Goubau | 343/828 |
| 4,180,819 A | | 12/1979 | Nakano | 343/792 |
| 4,330,783 A | | 5/1982 | Toia | 343/749 |
| 4,342,037 A | * | 7/1982 | Dalby | 343/846 |
| 4,369,449 A | | 1/1983 | MacDougall | 343/790 |
| 4,479,130 A | | 10/1984 | Snyder | 343/802 |
| 4,509,056 A | * | 4/1985 | Ploussios | 343/791 |
| 4,604,628 A | | 8/1986 | Cox | 343/818 |
| 5,181,044 A | | 1/1993 | Matsumoto et al. | 343/752 |
| 5,796,369 A | | 8/1998 | Henf | 343/752 |
| 5,798,736 A | * | 8/1998 | Hall | 343/791 |
| 5,982,336 A | | 11/1999 | Wen et al. | 343/793 |
| 6,034,648 A | * | 3/2000 | Hope | 343/790 |
| 6,133,889 A | | 10/2000 | Yarsunas et al. | 343/792.5 |

* cited by examiner

*Primary Examiner*—Don Wong
*Assistant Examiner*—Shih-Chao Chen
(74) *Attorney, Agent, or Firm*—Birdwell, Janke & Durando, PLC

(57) ABSTRACT

A low loss, compact radio antenna and antenna loading method. For a monople antenna a tubular, conductive radiating element provided whose length is less than one-quarter the wavelength of the nominal frequency of the antenna. A tubular conductive series loading element disposed within the radiating element, the series loading element having a first end for connection to a radio and being electrically connected to the radiating element at a position spaced outwardly from the first end so as to provide inductance in series with the radiating element. An elongate conductive shunt matching element is disposed within the series loading element for electrically connecting the series loading element from a point therein to a mirror image thereof so as to provide shunt inductance that matches the impedance of the antenna to the impedance of a device connected thereto at the nominal frequency. An electromagnetic mirror is provided in the form of a ground plane, or in the form of a second combination of radiating element and series loading element so as to provide a dipole antenna.

35 Claims, 9 Drawing Sheets

LOW LOSS LOADING, COMPACT ANTENNA AND ANTENNA LOADING METHOD

BACKGROUND OF THE INVENTION

This invention relates to radio antennas, and particularly to antennas whose size is reduced relative to the nominal operating frequency, or wavelength, of the antenna with minimal resistive power loss.

In radio communications it is often desirable to minimize the size of a radio antenna. This may be the case, for example, to fit the antenna into a limited space, to reduce the material cost of the antenna or its support system, or simply to reduce obtrusiveness of the antenna. At the same time, there is a need to achieve maximum power transfer between the radio to which the antenna is connected and free space. Generally, these are conflicting objectives, because maximum power transfer can only be achieved with a perfect, lossless impedance match, which is defeated by deviation from the optimal size of the antenna for a given operating frequency.

It is known that the electrical length of an antenna can be increased by providing a coil inductor in series with the input to the radiating elements. It is also known that, to match the impedance of a combination of radiating elements and series inductors to a standard transmission line having a characteristic impedance of, for example, 50 ohms, a coil inductor may be placed across the input to the antenna. However, while these techniques permit a dipole antenna to be shorter than one-half wavelength at the nominal operating frequency of the antenna, and a monopole antenna to be shorter than one-quarter wavelength at the nominal operating frequency, they also introduce resistive losses and thereby reduce the power radiated by the antenna or, conversely, received by the radio. This is because the coils have capacitive coupling between loops that require an actual coil to be longer than would be required for an ideal inductor, and the wires of the coils must, as a practical matter, have a much lower diameter than the radiating elements, both of which increase the effective resistance that a radio frequency signal encounters. Moreover, coil inductors will radiate and, due to their geometry, vary the radiation pattern of the antenna from the ideal pattern.

Accordingly, it would be desirable to be able to introduce inductance to shorten the required length of an antenna, and to match the input impedance of the antenna to a transmission line, without introducing unnecessary resistance and without degrading the antenna's pattern.

SUMMARY OF THE INVENTION

The present invention satisfies the afore-mentioned desire by providing a low loss, compact radio antenna and antenna loading method. For a monopole antenna a tubular, conductive radiating element is provided whose length is less than one-quarter of the wavelength of the nominal operating frequency of the antenna. A tubular conductive, loading element is disposed within the radiating element and substantially coaxial therewith, the loading element having a first end for connection to a radio and being electrically connected to the interior surface of the radiating element at a position spaced outwardly from the first end so as to provide inductance in series with the radiating element. An elongate conductive shunt element is disposed within the loading element for electrically connecting the interior surface of the loading element from a point therein spaced outwardly from the first end to a mirror image thereof, so as to provide shunt inductance that matches the impedance of the antenna to the impedance of a transmission line connected thereto at the nominal frequency. An electromagnetic mirror is provided in the form of a ground plane, or in the form of a second combination of radiating element and loading element so as to provide a dipole antenna.

In either case, the loading element may be connected to its respective radiating element at the ends thereof, or at a point interior therefrom, to tune the antenna to a different frequency. The antenna may be tuned selectively by using switches or variable positioning devices to change the connections between the loading elements and the radiating elements, or by introducing a conductive or dielectric material between the loading and radiating elements. Capacitive hats may be provided at the outer ends of the antenna to provide increased current flow at the outer ends of the radiators in order to raise the antenna's radiation resistance and thereby lower its Q.

Accordingly, it is a principal object of the present invention to provide a novel and improved high-frequency radio antenna whose size is reduced for its nominal operating frequency but that provides relatively low power loss.

It is another object of the invention to provide a low-loss, compact monople antenna whose length is substantially less than one-quarter wavelength at the nominal operating frequency.

It is a further object of the invention to provide a low-loss, compact dipole antenna whose length is substantially less than one-half wavelength at the nominal operating frequency.

It is yet another object of the present invention to provide a radio antenna whose length is reduced by providing an elongate, tubular loading inductor in series with a radiating element and an elongate shunt matching inductor across the antenna input wherein the inductors introduce minimal resistive power loss.

It is yet a further object of the present invention to provide a radio antenna whose length is reduced by providing an elongate, tubular loading inductor in series with a radiating element and an elongate shunt matching inductor across the antenna input wherein the loading inductors are shielded from radiation.

The foregoing and other objects, features, and advantages of the invention will be more readily understood upon consideration of the following detailed description of the invention, taken in conjunction with the accompanying drawings.

DETAILED DESCRIPTION OF THE INVENTION

Figure 1:
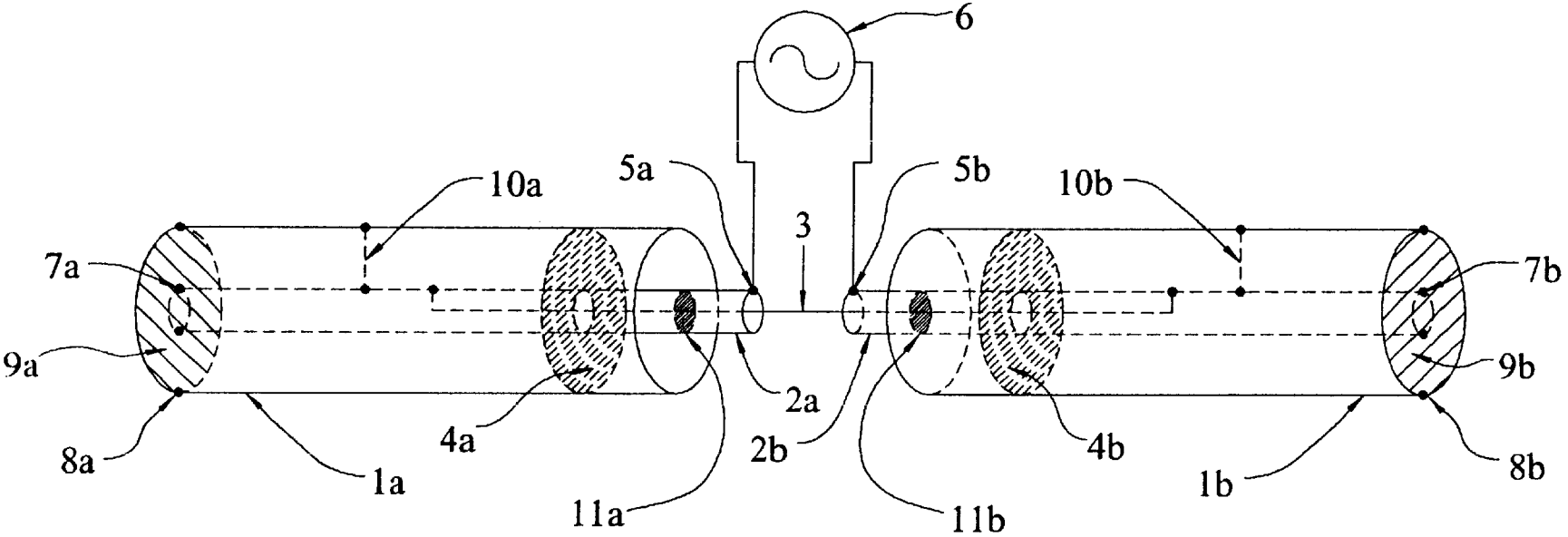
FIG. 1 is a diagrammatic representation of a first embodiment of an antenna according to the principles of the invention, connected to a signal source.

Referring first to FIG. 1, a preferred embodiment of the antenna of the present invention comprises a pair of radiating elements 1*a* and 1*b,* series loading elements 2*a* and 2*b* disposed within the radiating elements, and a shunt matching element 3 disposed within the series loading elements. The radiating elements are tubes of conductive material, preferably cylindrical in cross section, and are co-linear with one another so as to form a dipole antenna. They would typically be formed from sections of metal tubing, such as aluminum, supported by insulators, as is commonly understood in the art. The series loading elements are also tubes of conductive material and are co-linear with one another. However, it is to be understood that the term "tube" as used in this application is intended to include any elongate structure that behaves electrically like a tube at radio frequencies, such as, for example, a hollow structure formed of a conductive mesh whose mesh size is much smaller that the wavelength of the radio frequency.

The series loading elements may be made of the same material as the radiating elements and may be supported in place within the radiating elements by insulators, such as insulating disks 4*a* and 4*b,* as will be understood by a person skilled in the art. However, it has been found that satisfactory results can be achieved by constructing the loading elements from two segments of standard 50 ohm coaxial cable wherein the shield conductors comprise the series loading elements, and the central conductors of the two segments are connected together to form the shunt matching element. While the loading elements are shown in FIG. 1 to have axes that are collinear with one another and with the radiating elements, that need not necessarily be so. The loading elements actually may be offset from the common axis of the radiating elements and from one another without departing from the principles of the invention.

The interior ends 5*a* and 5*b* of the series loading elements 2*a* and 2*b* provide an input-output port, or electrical connection for connecting a radio to the antenna. This is illustrated in FIG. 1 by a signal source 6 connected to interior ends 5*a* and 5*b*. The series loading elements 2*a* and 2*b* are connected to the interior surfaces of respective radiating elements 1*a* and 1*b* at positions spaced outwardly from the interior ends 5*a* and 5*b*. As the antenna current at high frequencies flows effectively on the surface of the conductors, only the exterior surface of the radiating elements actually radiates, and the loading elements, together with the respective interior surfaces of the radiating elements, act as a series inductance to the exterior, radiating surface of the radiating elements.

In the preferred embodiment, the ends 7*a* and 7*b* of the series loading elements are connected to respective ends 8*a* and 8*b* of the radiating elements by respective conductive disks 9*a* and 9*b*. However, the series loading elements may be connected to the interior surfaces of the radiating elements at other locations within the radiating elements, as shown by alternative connections 10*a* and 10*b,* to tune the antenna to a desired nominal frequency different from that to which the antenna would be tuned by restricting the connections to the ends of the radiating elements.

The shunt matching element 3 is an electrical conductor connected from a point inside series loading element 2*a* to a corresponding point inside series loading element 2*b,* thereby providing a shunt inductance across the two loading elements. The shunt element preferably is a rigid wire supported by a pair of insulating disks 11*a* and 11*b* within the respective loading elements 2*a* and 2*b,* but it could also simply be an insulated wire disposed within the tubular series loading elements and supported thereby as well.

Together, the series loading elements 2*a* and 2*b,* and the shunt matching element 3, increase the nominal operating frequency of the dipole antenna formed by the radiating elements 1*a* and 1*b* so that the dipole antenna may be shorter in length for a given nominal operating frequency than would otherwise be required.

Figure 2:
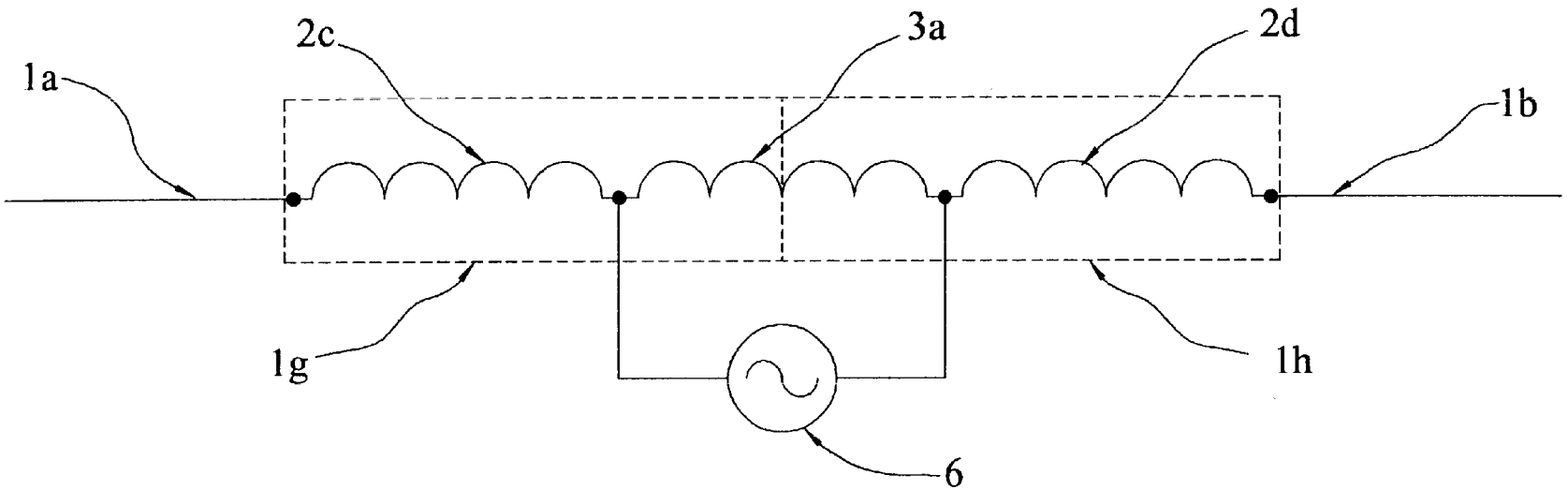
FIG. 2 is a schematic diagram of an equivalent circuit for the antenna of FIG. 1 using idealized inductors.

FIG. 2 shows a schematic diagram of the dipole antenna of FIG. 1 so as to illustrate its electrical properties more clearly. Thus, the series loading elements 2*a* and 2*b* are represented by idealized inductors 2*c* and 2*d,* respectively, and the shunt matching element is represented by idealized inductor 3*a*. However, if actual coils were used for these elements, they would introduce unacceptable capacitive coupling between the windings and also distort the antenna field pattern. Boxes 1*g* and 1*h* represent shielding of the idealized inductors 2*c*, 2*d* and 3*a* so that they do not radiate. This shielding is actually provided by the radiating elements 1*a* and 1*b* in the physical device.

Figure 3:
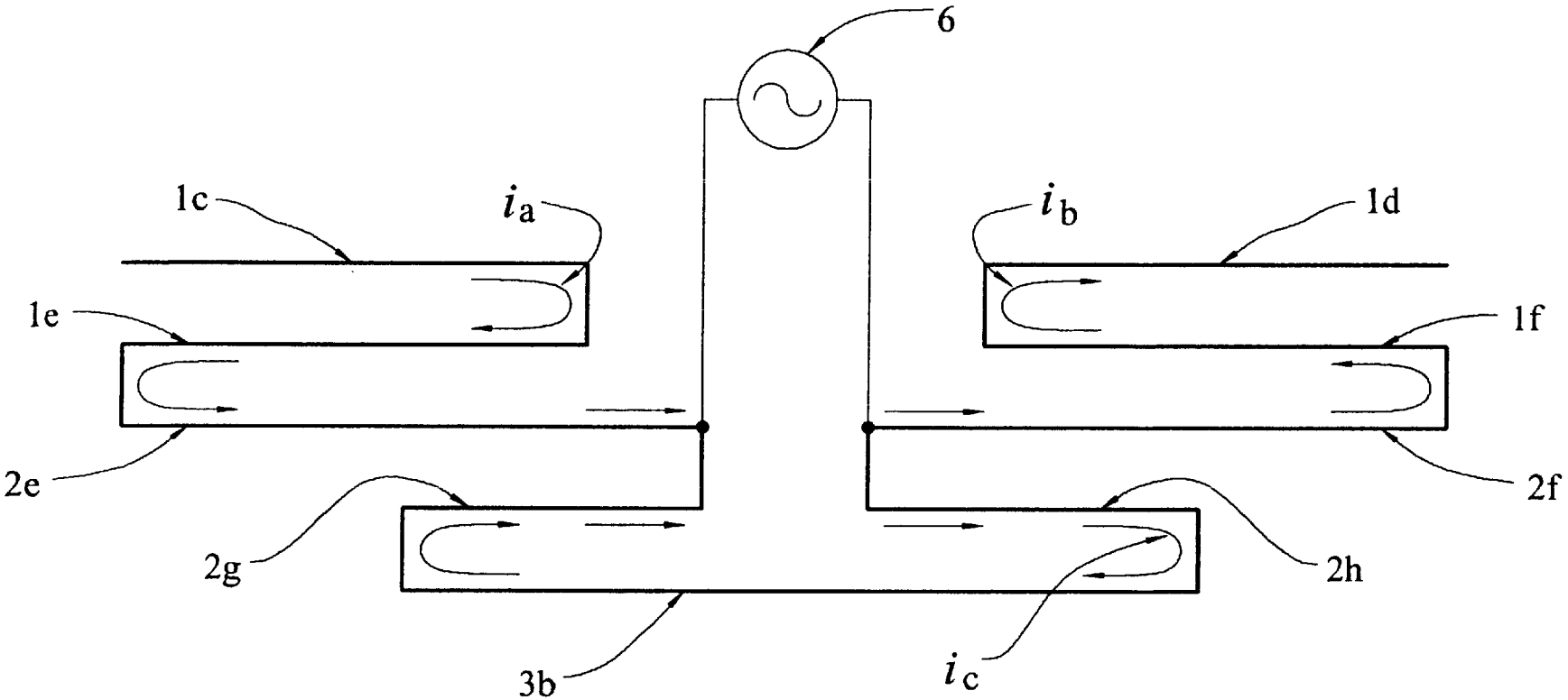
FIG. 3 is a current flow diagram for the antenna of FIG. 1.

The manner in which the series load inductances and the shunt load inductance are produced from the tubular radiating and loading elements and the shunt matching element is illustrated by a current flow diagram, FIG. 3. At radio frequencies, current in the physical elements is restricted to a small thickness near the surfaces of the elements. Thus, segments 1*c* and 1*d* represent the outer surfaces of radiating elements 1*a* and 1*b,* respectively, on which the respective currents $i_a$ and $i_b$ flow. Segments 1*e* and 1*f* represent the inner surfaces of those respective radiating elements. Segments 2*e* and 2*f* represent outer surfaces of the series loading elements 2*a* and 2*b,* respectively, on which currents $i_a$ and $i_b$ flow. Thus segments 2*e* and 1*e* comprise an inductance in series with radiating segment 1*c*. Together, segments 2*e* and 1*e* are equivalent to idealized inductor 2*c* in FIG. 2. Similarly, segments 2*f* and 1*f* comprise an inductance in series with radiating segment 1*d,* and are equivalent to idealized inductor 2*d* in FIG. 2.

The shunt inductance is produced by segment 2*g,* representing the inner surface of series element 2*a;* segment 3*b,* representing shunt element 3; and segment 2*h,* representing the inner surface of series element 2*b*. Current $i_c$ flows through these three segments, which are represented by idealized inductor 3*a* in FIG. 2.

Figure 4:
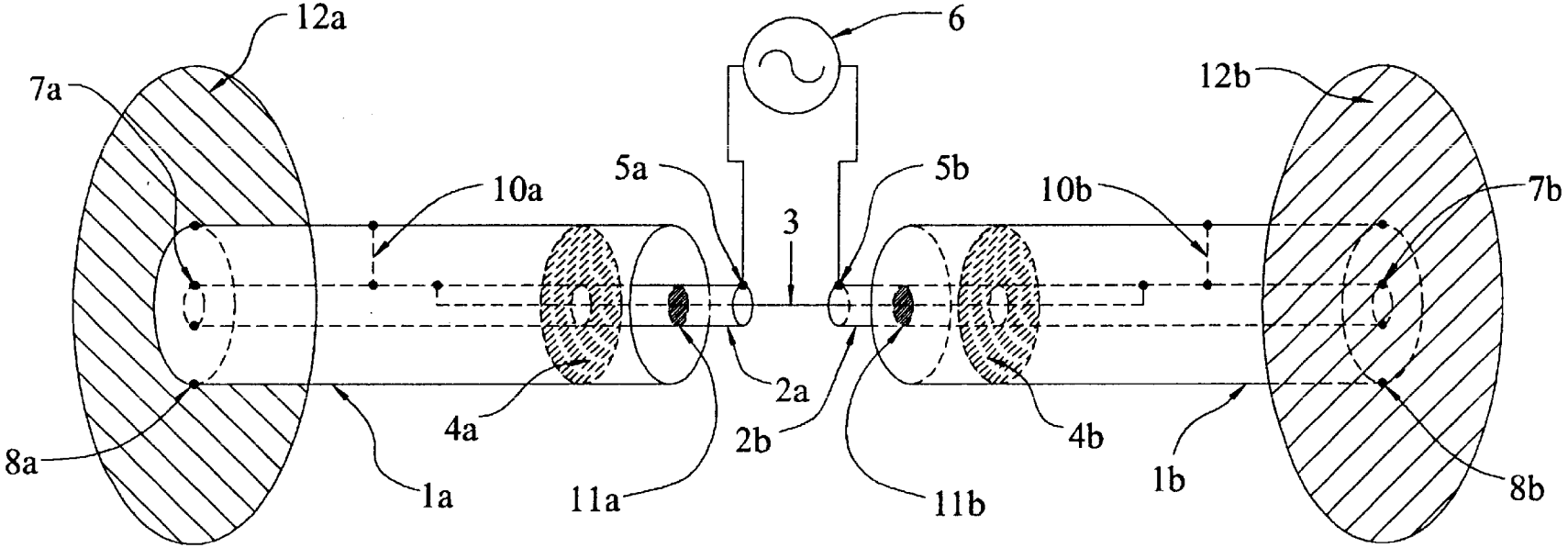
FIG. 4 is a diagrammatic representation of a second embodiment of an antenna including an alternative capacitive hat according to the principles of the invention, connected to a signal source.

Turning to FIG. 4, a first alternative embodiment of the antenna invention employs capacitive hats 12*a* and 12*b* disposed at the ends of the radiating elements 1*a* and 1*b,* both to connect the ends 8*a* and 8*b* of the radiating elements to respective ends 7*a* and 7*b* of the loading elements, and to provide additional self capacitance to the ends of the antenna element. That is, the capacitive hats are capacitor elements that increase radiation resistance and decrease antenna Q by causing higher current flow at the ends of the element.

Figure 5:
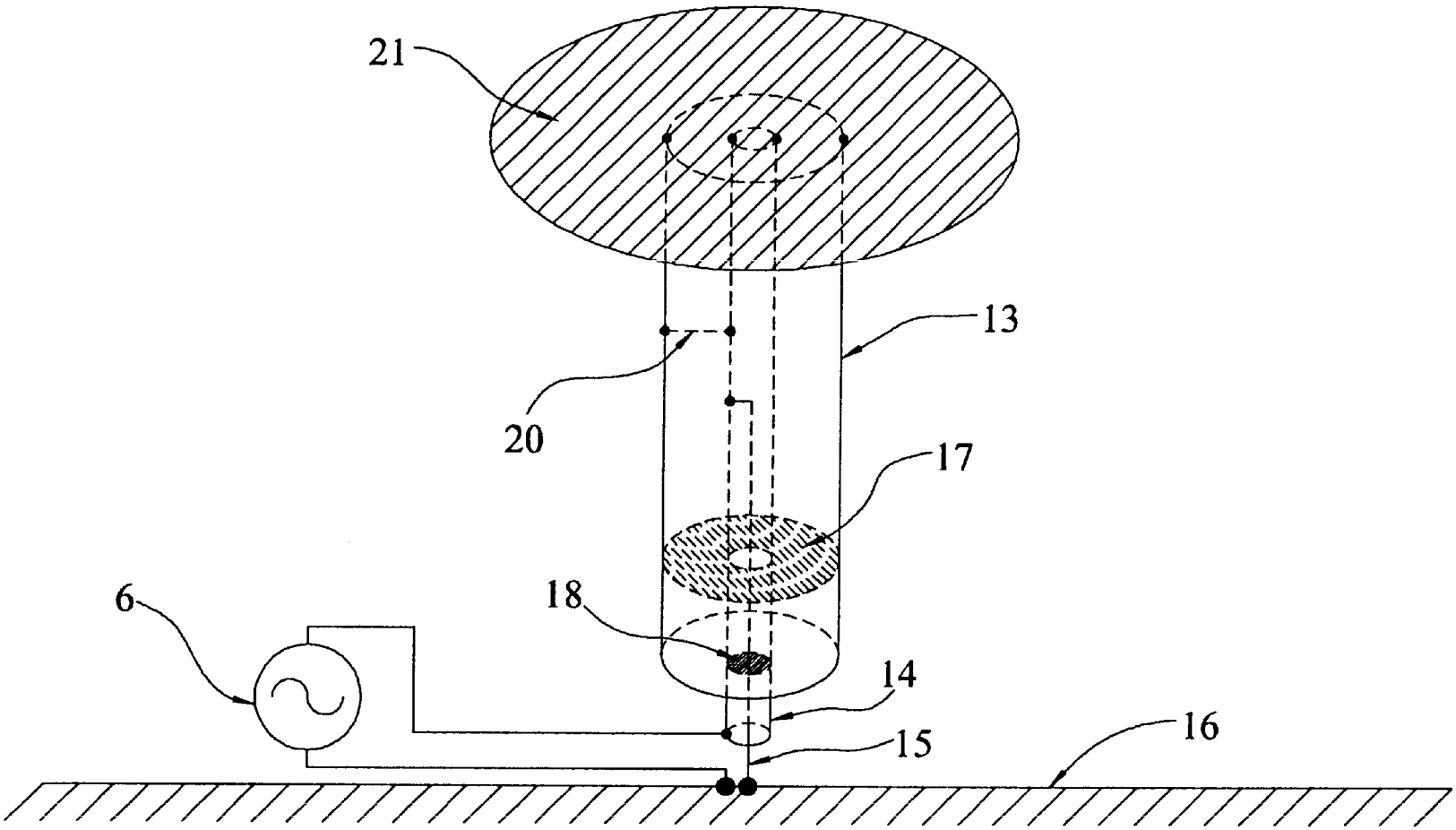
FIG. 5 is a diagrammatic representation of a third embodiment of an antenna including an alternative capacitive hat according to the principles of the invention, connected to a signal source.

The principles of the invention may be applied to a quarter-wave monopole antenna as well as a half-wave dipole antenna. As shown in FIG. 5, a monopole embodiment of the antenna comprises a single tubular, conductive radiating element 13, a single tubular, conductive series loading element 14 disposed within the radiating element 13, and a conductive shunt matching element 15 disposed within the series loading element 14. In this case, the radiating and series loading elements are mounted on and substantially perpendicular to an effective ground plane 16, and the shunt element 15 is connected from a point within the loading element to the effective ground plane. As will be understood by persons of ordinary skill in the art, the ground plane acts as an antenna mirror, that is, its effect is to provide an electromagnetic mirror image of the monopole antenna so that the monopole is equivalent to a dipole.

As in the case of the dipole embodiments, the radiating element and loading elements of the monople embodiment are preferably cylindrical in cross section, the series loading element preferably being connected to the radiating element at their respective ends opposite the ground plane 16 and the end of the loading element adjacent the ground plane providing the connection to a radio, as illustrated by signal source 6. The loading element may be held in place within the radiating element by an insulating disk 17, and the shunt element may be held in place within the loading element by insulating disk 18. However, a segment of standard coaxial cable can be used to form these elements. Also as in the case of the dipole antenna, the loading element may be selectively connected at a location 20 other than the ends of the loading and radiating elements to tune the antenna to a desired nominal operating frequency, the connections being made by switches or relays. Further, a capacitive hat 21 may be provided both to connect the ends of the radiating and loading elements and to provide self capacitance for reducing the Q of the antenna. In practice, the ground plane 16 may be any object which serves the electrical function of a ground plane, such as the surface of a building or vehicle, or a field of outwardly-radiating conductors or a screen, and is not restricted to the ground per se.

Figure 6A:
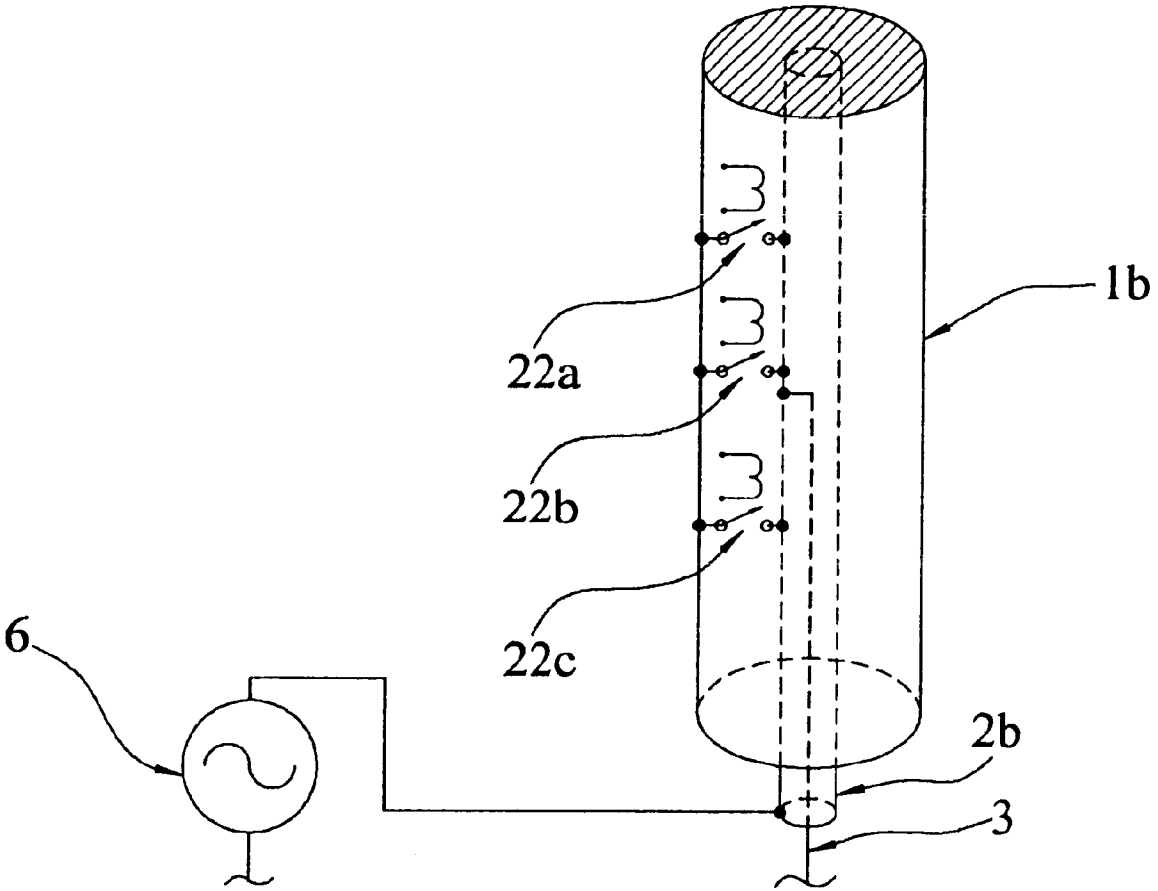
FIG. 6*a* is a diagrammatic representation of one-half of a dipole antenna embodiment of the invention showing a plurality of relays for selectively tuning the antenna.
Figure 6B:
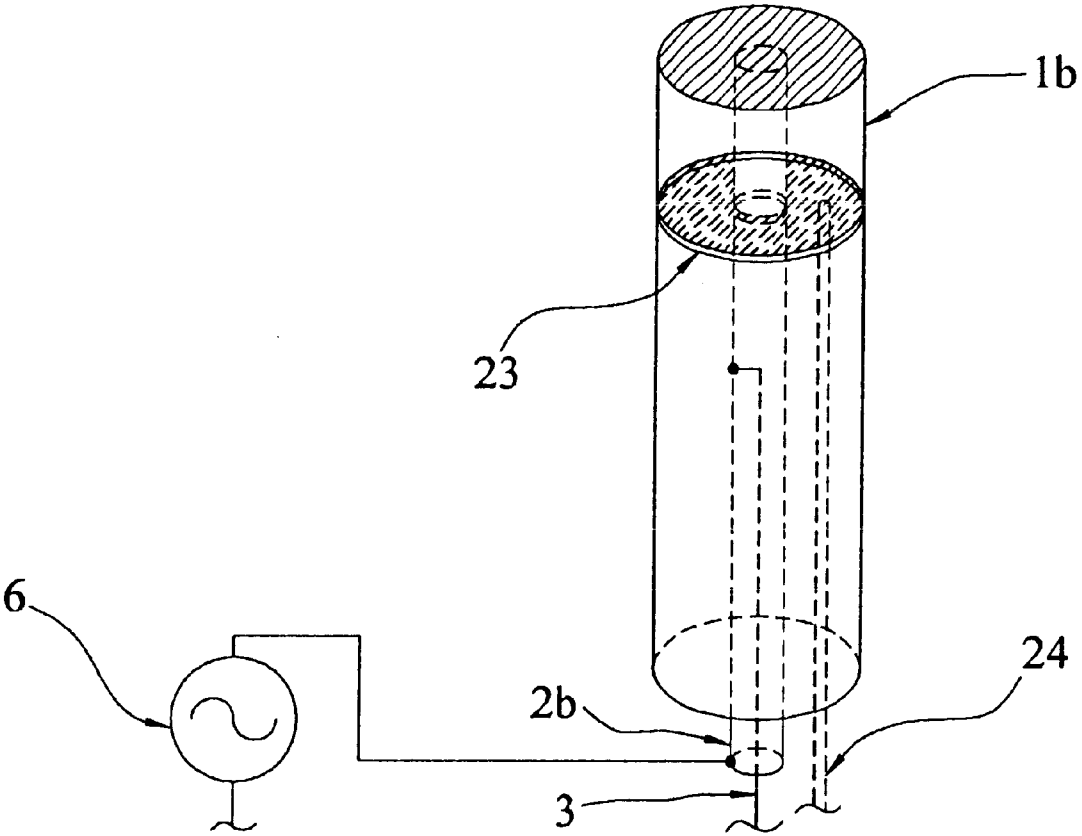
FIG. 6*b* is a diagrammatic representation of one-half of a dipole antenna embodiment of the invention showing a variable position shorting disk for tuning the antenna.
Figure 6C:
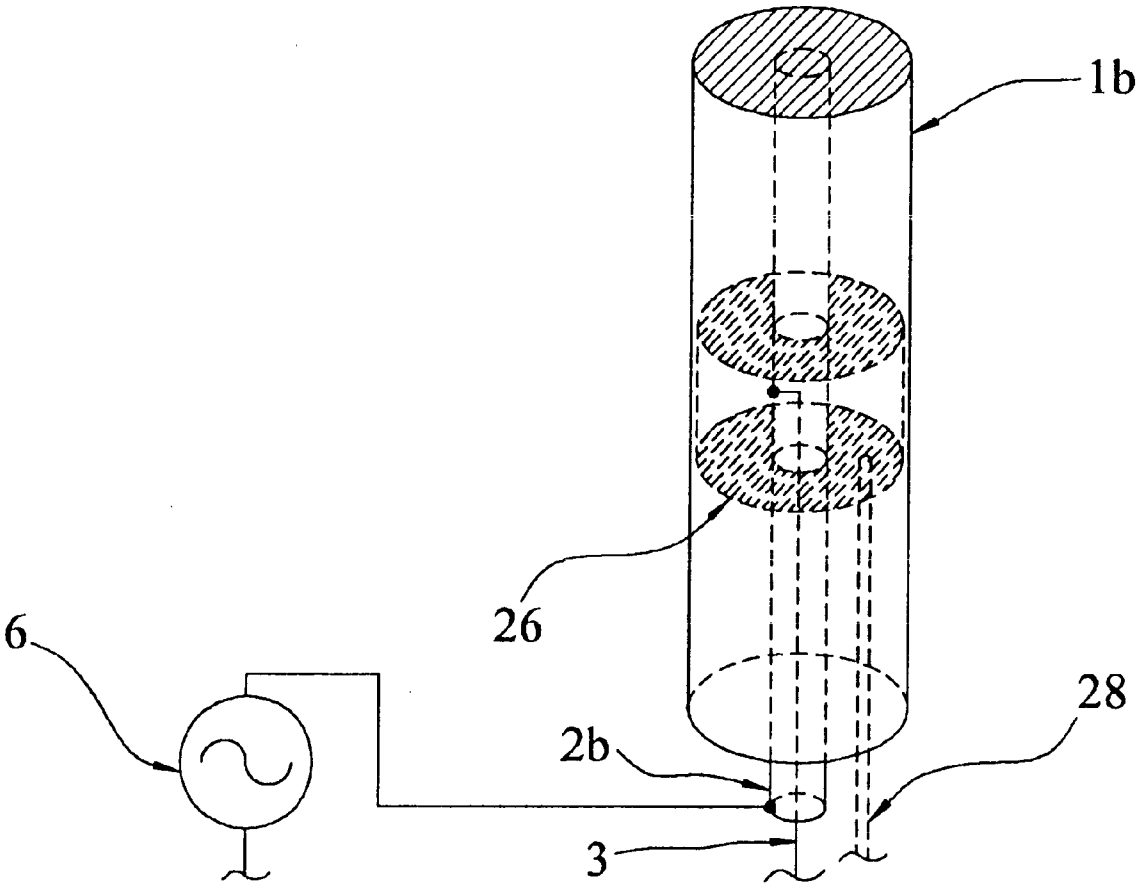
FIG. 6*c* is a diagrammatic representation of one-half of a dipole antenna embodiment of the invention showing a solid tuning plug.
Figure 6D:
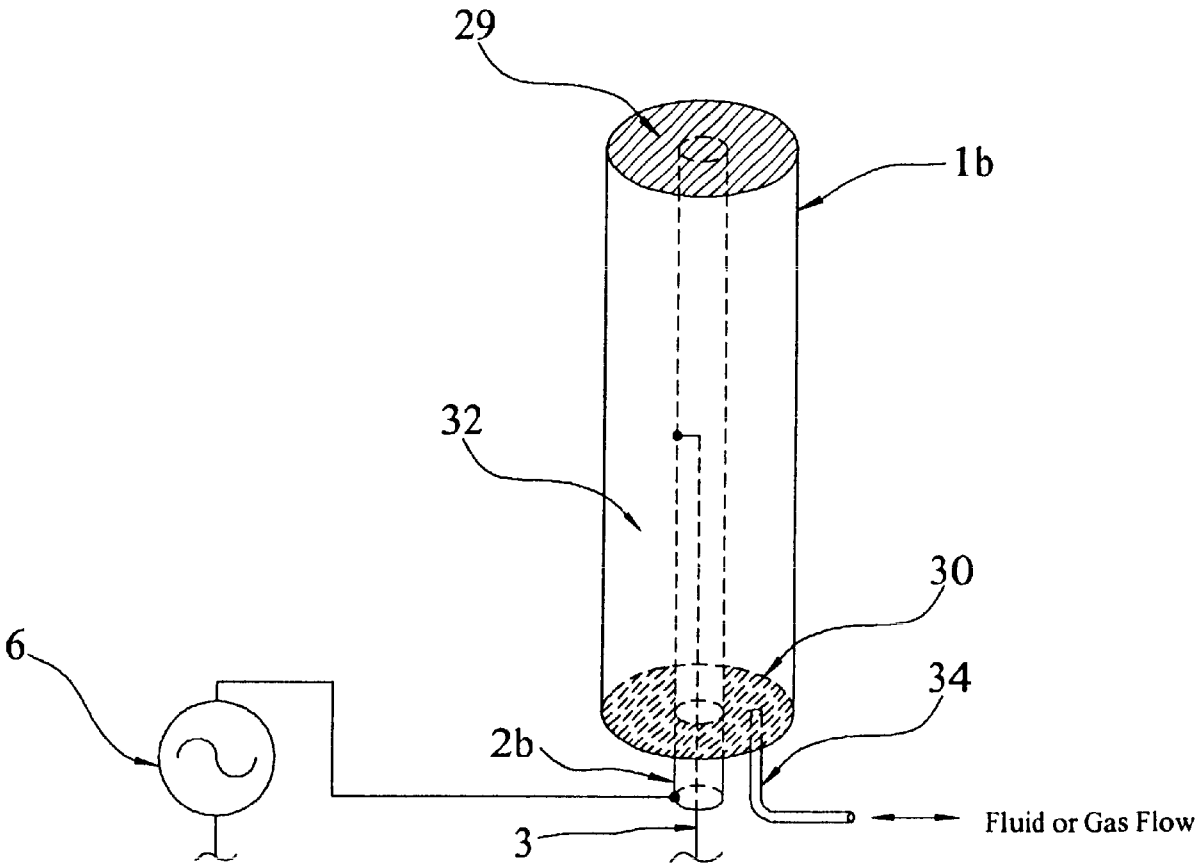
FIG. 6*d* is a diagrammatic representation of one-half of a dipole antenna embodiment of the invention showing a fluid disposed in sealed chamber between the loading and radiating elements for tuning the antenna.

In both the monopole and dipole embodiments of the invention described herein a number of alternative mechanisms may be used to tune the antenna. Any mechanism which varies the surge impedance, the mechanical length or the effective electrical length of the transmission line formed by the outer surface of the loading element and the inner surface of the radiating element can be used to vary the operating frequency of the antenna. Alternative examples are shown in FIGS. 6*a*–6*d,* which are diagrammatic representations of one-half of a dipole antenna embodiment of the invention. In FIG. 6*a,* a plurality of relays 22*a*–22*c,* are used to vary the positions of connections between the loading and radiating elements. Other switches could be used rather than relays. In FIG. 6*b,* a shorting disk 23 is adapted to slide in the longitudinal dimension of the antenna and short the loading element 2*b* to the radiating element 1*b.* The disc may be moved, for example, by an insulated rod 24. In FIG. 6*c,* a plug 26, made of a dielectric material or a conductive material insulated from the loading and radiating elements, is movably disposed between the loading and radiating elements so as to tune the antenna by moving tuning rod 28. In FIG. 6*d,* a sealed chamber between the loading and radiating elements is formed by conductive disk 29 and a sealing disk 30 made of insulating material, so as to retain a dielectric fluid 32 therein. The fluid is introduced through pipe 34. The fluid may be either a liquid or a gas, the dielectric characteristics of the fluid varying the operating frequency of the antenna. In the case of a gas, the pressure can be varied to tune the antenna. A suitable gas for this purpose is sulfur hexaflouride. The antenna could also be tuned by varying the ratio of diameters of the loading and radiating elements. Other mechanisms for adjusting the impedance or velocity factor of the transmission line formed by the loading and interior of the radiating element to tune the antenna could be used without departing form the principles of the invention.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only the claims which follow.

I claim:

1. A radio antenna for operation at a nominal frequency, comprising:

a pair of substantially co-linear, tubular, conductive radiating elements disposed substantially end-to-end, the total length of said pair of radiating elements being less than one-half the wavelength of the nominal frequency; and a pair of tubular conductive loading elements disposed substantially end-to-end within said respective pair of radiating elements with a gap there between, said loading elements being electrically connected to respective said radiating elements at respective positions spaced outwardly from the center of the antenna so as to provide inductance in series with said radiating elements, the inner ends of said loading elements at said gap comprising the connection point for the antenna.

2. The antenna of claim 1, further comprising an elongate conductive shunt element disposed within and electrically interconnecting said pair of loading elements from a point inside one said loading element to a corresponding point inside the other said loading element so as to provide shunt inductance that matches the impedance of the antenna to the impedance of a device connected thereto at the nominal frequency.

3. The antenna of claim 1, wherein said radiating elements and said loading elements have substantially cylindrical cross sections.

4. The antenna of claim 1, wherein the electrical connection of said loading elements to said radiating elements is at the respective outer ends of said loading elements.

5. The antenna of claim 4, wherein the electrical connection of said loading elements to said radiating elements is at the respective outer ends of said radiating elements.

6. The antenna of claim 5, further comprising a pair of conductive plates disposed at respective outer ends of said loading elements to provide the electrical connection of said loading elements with said radiating elements.

7. The antenna of claim 6, wherein said radiating elements and said loading elements have substantially cylindrical cross sections, said plates are discs, and said discs have a diameter greater than the diameters of said respective radiating elements so as to provide self capacitance at the ends of said radiating elements.

8. The antenna of claim 7, further comprising an elongate conductive shunt element disposed within and electrically interconnecting said pair of loading elements from a point inside one said loading element to a corresponding point inside the other said loading element so as to provide shunt inductance that matches the impedance of the antenna to the impedance of a device connected thereto at the nominal frequency.

9. The antenna of claim 1, further comprising a plurality of selectively switchable electrical connections between said loading elements and said respective radiating elements for tuning said antenna by varying its electrical length.

10. The antenna of claim 1, further comprising a pair of shorting disks adapted to slide between a respective loading element and radiating element for tuning said antenna by varying its electrical length.

11. The antenna of claim 1, further comprising a pair of dielectric plugs adapted to slide between a respective loading element and radiating element for tuning said antenna by varying its electrical length.

12. The antenna of claim 1, further comprising a pair of conductive plugs disposed between, insulated from, and adapted to slide between a respective loading element and radiating element for tuning said antenna by varying its electrical length.

13. The antenna of claim 1, further comprising a pair of conductive plates disposed at respective outer ends of respective loading elements to provide electrical connection of said loading elements with said radiating elements and a pair of insulating disks disposed at respective inner ends of respective loading elements so as to form chambers between respective loading and radiating elements, and respective inlets to said chambers for introducing a dielectric fluid into said chambers for tuning said antenna.

14. A radio antenna for operation at a nominal frequency, comprising:

a tubular, conductive radiating element whose length is less than one-quarter the wavelength of the nominal frequency, said radiating element being disposed substantially perpendicularly to an effective ground plane; and a tubular conductive loading element disposed within said radiating element, said loading element being electrically connected to said radiating element at a position spaced outwardly from said effective ground plane so as to provide inductance in series with said radiating element, the end of said loading element adjacent said ground plane comprising the connection point for the antenna.

15. The antenna of claim 14, further comprising an elongate conductive shunt element disposed within and electrically interconnecting said loading element from a point inside said loading element to said effective ground plane so as to provide shunt inductance that matches the impedance of the antenna to the impedance of a device connected thereto at the nominal frequency.

16. The antenna of claim 14, wherein said radiating element and said loading element have substantially cylindrical cross sections.

17. The antenna of claim 14, wherein the electrical connection of said loading element to said radiating element is at the outer end of said loading element.

18. The antenna of claim 15, wherein the electrical connection of said loading element to said radiating element is at the outer end of said radiating element.

19. The antenna of claim 18, further comprising a conductive plate disposed at the outer end of said loading element to provide the electrical connection of said loading element with said radiating element.

20. The antenna of claim 19, wherein said radiating element and said loading element have substantially cylindrical cross sections, said plate is a disc, and said disc has a diameter greater than the diameter of said radiating element so as to provide self capacitance at the end of said radiating element.

21. The antenna of claim 14, further comprising an elongate conductive shunt element disposed within and electrically interconnecting said loading element from a point inside said loading element to said effective ground plane so as to provide shunt inductance that matches the impedance of the antenna to the impedance of a device connected thereto at the nominal frequency.

22. The antenna of claim 14, further comprising a plurality of selectively switchable electrical connections between said loading element and said radiating element for tuning said antenna by varying its electrical length.

23. The antenna of claim 14, further comprising a shorting disk adapted to slide between said loading element and said radiating element for tuning said antenna by varying its electrical length.

24. The antenna of claim 14, further comprising a dielectric plug adapted to slide between said loading element and said radiating element for tuning said antenna by varying its electrical length.

25. The antenna of claim 14, further comprising a conductive plug disposed between, insulated from, and adapted to slide between said loading element and said radiating element for tuning said antenna by varying its electrical length.

26. The antenna of claim 14, further comprising a conductive plate disposed at the outer end of said loading element to provide electrical connection of said loading element with said radiating element and an insulating disk disposed at the inner end of said loading element so as to form a chamber between said loading and radiating elements, and an inlet to said chamber for introducing a dielectric fluid into said chamber for tuning said antenna.

27. A method for loading an antenna so as to combine low power loss with reduced antenna size for a given nominal operating frequency, comprising:

providing a tubular, conductive radiating element with one end adjacent an electromagnetic mirror, the length of said radiating element being less than one-quarter the wavelength of the nominal operating frequency; and placing a tubular, conductive loading element within said radiating element with one end adjacent said mirror and electrically connecting said loading element with said radiating element at a position spaced outwardly from said mirror so as to provide inductance in series with said radiating element, the end of said loading element adjacent said mirror comprising the connection point for the antenna.

28. The method of claim 27, further comprising placing an elongate conductive shunt element within said loading element and electrically connecting said shunt element to said loading element at a point therein to said mirror so as to provide shunt inductance that matches the impedance of the antenna to the impedance of a device connected thereto at the nominal frequency.

29. The method of claim 28, further comprising providing a mirror that is substantially identical to said combination of radiating element, loading element and shunt element.

30. The method of claim 28, further comprising providing a mirror that is an effective ground plane.

31. The method of claim 27, further comprising providing a conductive plate for electrically connecting the end of said loading element opposite said mirror to the end of said radiating element opposite said mirror.

32. The method of claim 30, further comprising providing self capacitance at the end of said antenna opposite said mirror by employing a plate whose outer periphery extends beyond the outer periphery of said radiating element.

33. The method of claim 27, further comprising selectively electrically connecting said loading element to said radiating element at a position therein so as to tune said antenna to a corresponding nominal operating frequency.

34. The method of claim 27, further comprising introducing a dielectric material between said loading element and said radiating element so as to tune said antenna.

35. The method of claim 27, further comprising introducing an insulated conductive material between said loading element and said radiating element so as to tune said antenna.

* * * * *